US007290475B2

(12) United States Patent
Fluhr

(10) Patent No.: US 7,290,475 B2
(45) Date of Patent: Nov. 6, 2007

(54) BLANK CARTRIDGE DEVICES FOR ATTACHMENT OVER A MUZZLE FLASH SUPPRESSOR

(75) Inventor: Norbert Fluhr, Oberndorf/Neckar (DE)

(73) Assignee: Heckler & Koch, GmbH, Oberndorf/Neckar (DE)

( * ) Notice: Subject to any disclaimer, the term of this patent is extended or adjusted under 35 U.S.C. 154(b) by 254 days.

(21) Appl. No.: 11/177,908

(22) Filed: Jul. 8, 2005

(65) Prior Publication Data

US 2007/0017357 A1 Jan. 25, 2007

Related U.S. Application Data

(63) Continuation-in-part of application No. PCT/EP04/01025, filed on Feb. 4, 2004.

(30) Foreign Application Priority Data

Feb. 11, 2003 (DE) ..... 103 05 644

(51) Int. Cl.
*F41A 21/34* (2006.01)

(52) U.S. Cl. ..... 89/14.5; 89/14.2

(58) Field of Classification Search ..... 89/14.5, 89/14.2; 42/1.06

See application file for complete search history.

(56) References Cited

U.S. PATENT DOCUMENTS 1,671,327 A 5/1928 Studler (Continued)

FOREIGN PATENT DOCUMENTS

DE 1578381 6/1966
DE 19729565 A1 7/1997
DE 19855208 C1 11/1998

OTHER PUBLICATIONS

International Search Report for PCT/EP2004/001025 ; 2 pages.

(Continued)

*Primary Examiner*—Stephen M. Johnson
(74) *Attorney, Agent, or Firm*—Hanley, Flight & Zimmerman, LLC

(57) ABSTRACT

Blank cartridge devices for attachment over a muzzle flash suppressor and methods of operating the same are disclosed. A disclosed example includes a muzzle flash suppressor mounted on a barrel that includes a muzzle, a longitudinal bore including internal threading, an inner cone in communication with the longitudinal bore, and a lateral opening located in a side of the muzzle flash suppressor between the inner cone and the muzzle of the muzzle flash suppressor. A disclosed example further includes a blank cartridge device that includes a tube, a cover and a stop block. The tube is sized to penetrate the longitudinal bore of the muzzle flash suppressor, and the tube has external threading to threadingly engage the internal threading in the longitudinal bore of the muzzle flash suppressor. The tube also includes an outer cone to form a seal with the inner cone of the muzzle flash suppressor. The tube further defines a core bore that is in communication with the bore of the barrel. The core bore is blocked by a constriction that defines an injector bore to provide communication between the core bore and a forward portion of the core bore. The core bore is in communication with at least one radial hole. The cover radially circumvents the lateral openings of the muzzle flash suppressor. Also, the stop block receives the tube, and the stop block includes a blind hole in communication with the core bore when the stop block receives the tube and the blank cartridge device is mounted on the muzzle flash suppressor.

9 Claims, 3 Drawing Sheets

U.S. PATENT DOCUMENTS

| | | | | |
|---|---|---|---|---|
| 3,766,822 | A * | 10/1973 | Sophinos | 89/14.5 |
| 6,026,728 | A | 2/2000 | Guhring et al. | |
| 6,176,032 | B1 * | 1/2001 | Cohen et al. | 42/96 |
| 6,289,623 | B1 | 9/2001 | Cohen et al. | |
| 6,889,593 | B2 * | 5/2005 | Gühring et al. | 89/14.5 |

OTHER PUBLICATIONS

EPO928943A, 2 pages including English abstract.
Written Opinion of the International Searching Authority Corresponding to PCT/EP2004/001025, Sep. 16, 2005 ; 8 pages.

* cited by examiner

BLANK CARTRIDGE DEVICES FOR ATTACHMENT OVER A MUZZLE FLASH SUPPRESSOR

RELATED APPLICATION

This patent arises from a continuation-in-part of International Patent Application Serial No. PCT/EP2004/001025, which was filed on Feb. 4, 2004, and which is hereby incorporated herein by reference.

FIELD OF THE DISCLOSURE

This disclosure relates generally to firearms and, more particularly, to blank cartridge devices for attachment over a muzzle flash suppressor.

BACKGROUND

In most cases (e.g., the G3) the muzzle flash suppressor must be unscrewed during the use of a blank cartridge device and can, thus, be lost. However, some blank cartridge devices are pushed on and screwed to the muzzle flash suppressor (see DE 19 7 29 565 C2). In a prior art blank cartridge device the mounting device is complicated by a cross pin that extends behind the muzzle flash suppressor. This cross pin lies in the field of vision of the shooter so that he can always be assured of the proper fit of the blank cartridge device. However, in practice, the fact that this mount may not be secure may not be noticed due to inattention on the part of the shooter or due to environmental factors (e.g., if assembled during the night). If the mount is not fully engaged, the blank cartridge device may fly off during firing. This danger is particularly high when a round of live ammunition is shot by accident and must be caught by the blank cartridge device.

Moreover, there are weapons in which the outside diameter of the muzzle flash suppressor does not exceed the outer diameter of the barrel or exceeds it only slightly. Known blank cartridge devices cannot be mounted on this type of weapon.

German Patent No. DE-A-1,578,381 is prior art to this patent.

BRIEF DESCRIPTION OF THE DRAWINGS

All these figures refer to the same example and, thus, like reference numerals refer to like parts.

DETAILED DESCRIPTION

Throughout this patent, position designations such as "above," "below," "top"' "forward," "rear," etc. are referenced to a firearm held in a normal firing position (i.e., pointed away from the shooter in a generally horizontal direction).

Figure 1:
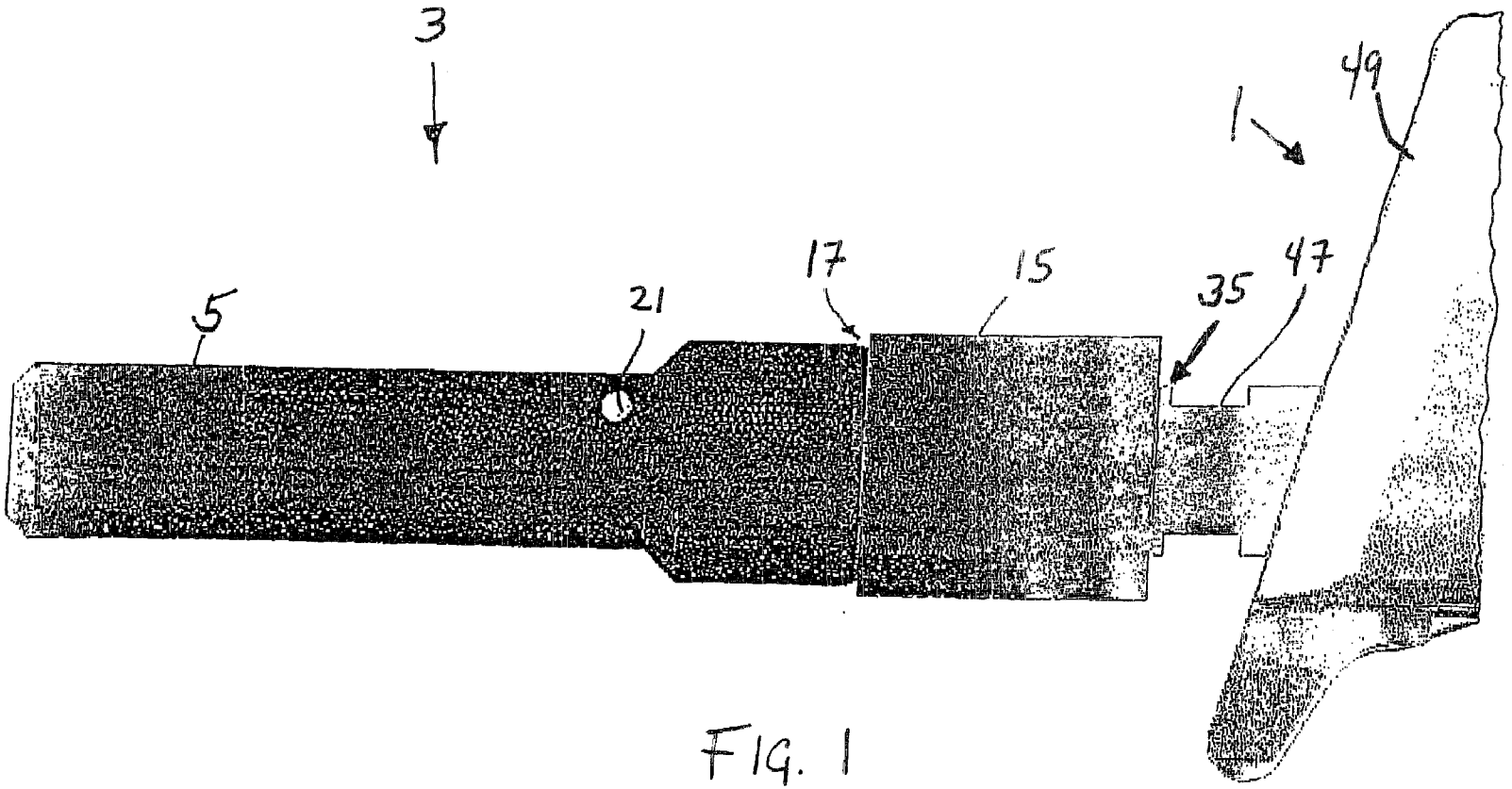
FIG. 1 is a side view of an example blank cartridge device that is screwed onto an example muzzle flash suppressor.
Figure 2:
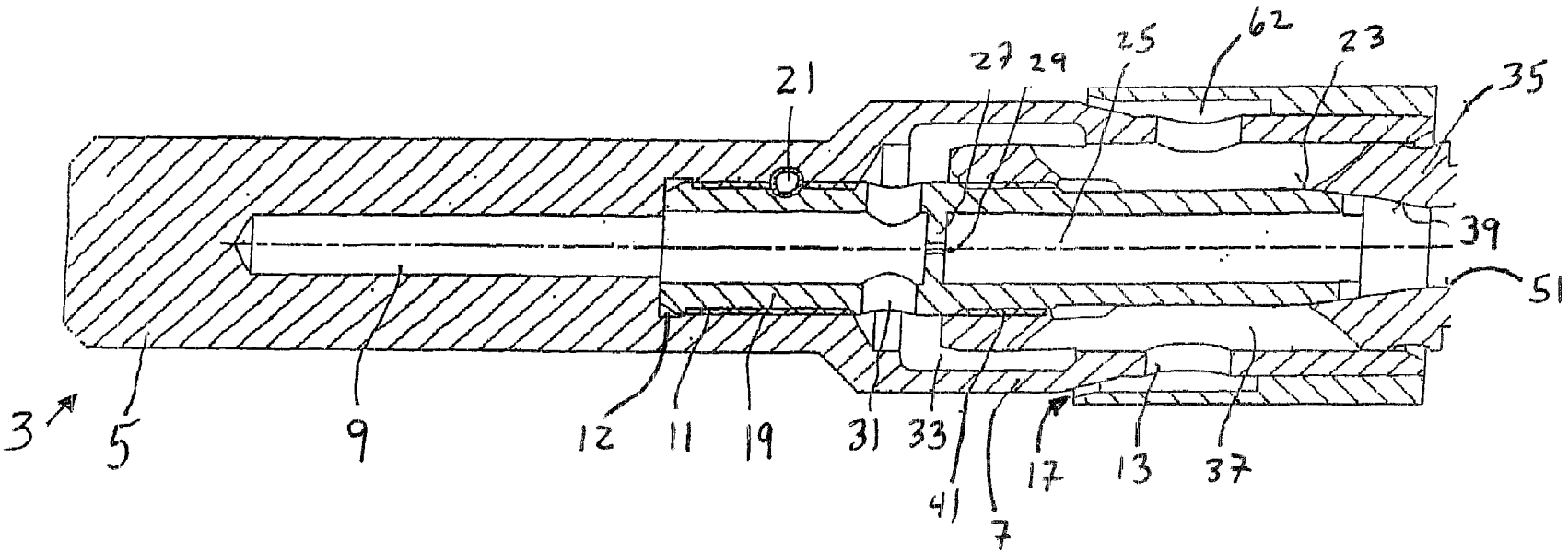
FIG. 2 is a longitudinal cross-sectional view of the muzzle flash suppressor of FIG. 1 shown with the blank cartridge device installed and in a ready-to-use position.
Figure 3:
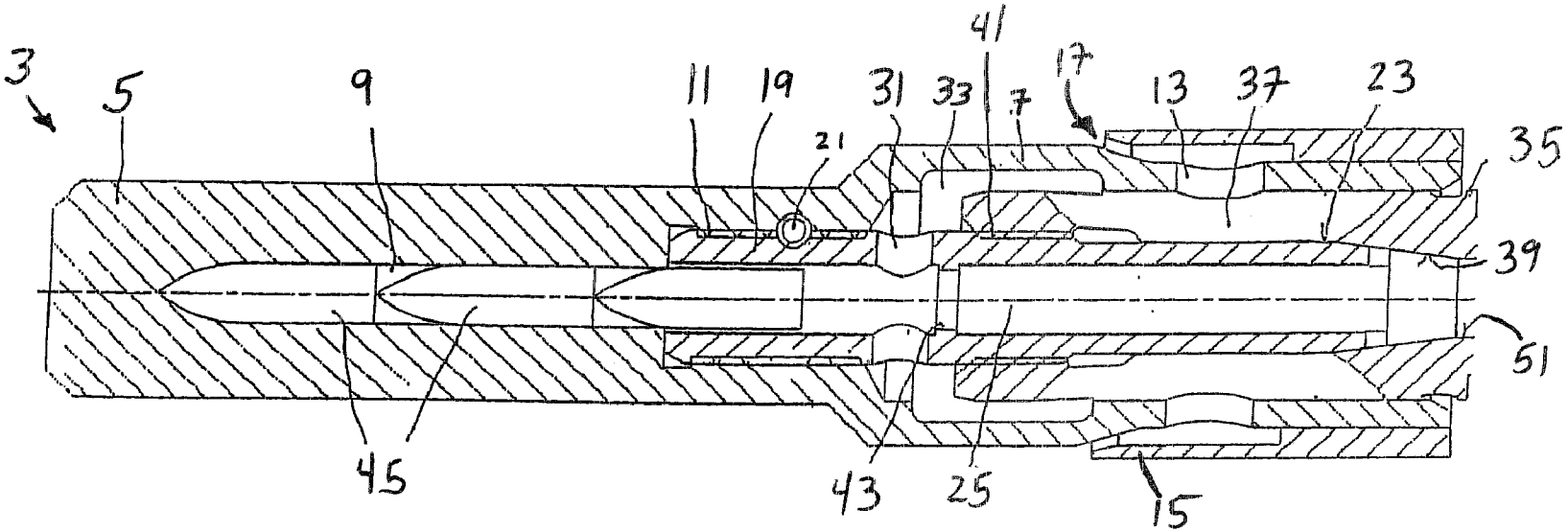
FIG. 3 is a cross-sectional view similar to FIG. 2, but shown after the firing of three live cartridges.

An example blank cartridge device (3) is shown mounted on an example muzzle flash suppressor (35) in FIGS. 1-3. The illustrated blank cartridge device (3) is connected to the front part of a rapid fire (e.g., an automatic or semiautomatic) gun (1). The firearm of the illustrated example has a hand guard (49), from which a barrel (47) projects towards the front (i.e., in the direction of firing). The example muzzle flash suppressor (35) is tightened onto the front end of the barrel (47) such that it cannot be loosened without the assistance of workshop tools. The tube (19) of the blank cartridge device (3) is screwed into the muzzle flash suppressor (35). An annular gap (17) from which firing gas can escape opens toward the front of the blank cartridge device (3).

FIG. 2 shows the structure of the muzzle flash suppressor (35) and the blank cartridge device (3). In the illustrated example, the muzzle flash suppressor (35) has an inner over-caliber bore hole (51), which extends from the muzzle of the barrel (47) over a short, cylindrical section that expands outward into an inner cone (39). Continuing forward, the bore hole (51) extends in a mainly cylindrical fashion to the firing opening. A fine internal thread is arranged in front of the firing opening and forms the female end of the thread connection (41). Elongated gas outlet openings (37) extending towards the outside. The gas outlet openings (37) connect the bore hole (51) with the area radially outside of the muzzle flash suppressor (35). The openings (37) are located between the inner cone (39) and the inner thread (41). These gas outlet openings (37) are customary. The exterior surface of the muzzle flash suppressor is cylindrical.

With a normal, live shot, when the blank cartridge device (3) is not attached to the muzzle flash suppressor (35), a portion of the firing gas is allowed to escape via the gas outlet openings (37) when the projectile flies through bore hole (51). These gases do not disrupt the flight of the projectile. Because some of the gases discharge via the outlets (37), the glare from the muzzle fire is reduced, and the firing noise may be located less precisely.

The blank cartridge device (3) comprises three parts: the center tube (19), a stop block (5) and an outer sleeve (15). The tube (19) fits into the bore hole (51) of the muzzle flash suppressor (35). The end of the tube (19), which is inserted into the bore hole (51) of the muzzle flash suppressor (35), is tapered. This tapered end, or outer cone (23) fits exactly with the inner cone (39) of the muzzle flash suppressor (35) to thereby form a tight cone seat that prevents any independent relative rotation between tube (19) and the muzzle flash suppressor (35). The tube (19) also has two external, fine threads that make a thread connection (41) with the muzzle flash suppressor (35). Further, the tube (19) defines a core bore hole (25) in communication with the bore of the barrel (47).

The tube (19) is screwed, via another thread connection (11), into an internal threaded, tapped blind hole (12) in the stop block (5) until the front end of the tube (19) sits tightly on the floor of the tapped blind hole (12). The threaded connection (11) is held against movement by a diagonal spring pin (21). The tube (19) and the stop block (5), thus, form one unit.

The tube (19) is first screwed into the muzzle flash suppressor (35) until the cone seat between the inner cone (39) and the outer cone (23) of the muzzle flash suppressor (35) and the tube (190) is created. Thus, the external thread of the thread connection (41) is completely seated in its internal thread.

The tube (19) is penetrated by a central core bore hole (25). The diameter of the core bore hole (25) is larger than the caliber of the weapon and is generally cylindrical, except for a constriction (27) located just in front of the front end of the muzzle flash suppressor (35) (i.e., in front of the external thread of the thread connection (41)). The illustrated constriction (27) locally constricts the core bore hole (25) to an injector bore hole (29). In the illustrated example, the constriction (27) forms a narrow cross web. The small diameter of the injector bore hole (29) dissipates the combustion gases in the barrel (47). This is required for the automatic reloading of the weapon (1) when using blank cartridges.

Two large, opposite-lying radial bore holes (31) penetrate the wall of the tube (19). These bore holes (31) are located between the constriction (27) and the external thread of the thread connection (11). All combustion gases that enter the core bore hole (25) leave the core bore hole (25) through the radial bore holes (31).

The core bore hole (25) continues into the center core bore hole (9) in the front part of the stop block (5). The core bore hole (25) and the center core bore hole (9) have the same diameter. The center core bore hole (9) forms a tapped blind hole (12).

The stop block (5) continues towards the back as one piece through a tubular extension (7). The tubular extension (7) has a mainly cylindrical inner diameter which is approximately similar to the outer diameter of the front part of the stop block (5). This inner diameter forms a seal with the center and the back part of the cylindrical outer surface of the muzzle flash suppressor (35). An expansion space (33) is formed by an expansion of the inner diameter of the extension (7) between the center seal and the front part of the extension (7). This expansion space (33) connects the radial bore holes (31) with the gas outlet openings (37) of the muzzle flash suppressor (35).

The back part of the extension (7) (which sits sealed on the outer surface of the muzzle flash suppressor (35)), has a crown of gas outlet openings (13) which radially connect the gas outlet openings (37) with the outside of the extension (7). In this manner, the combustion gases flow through the gas outlet openings (13, 37) and then through the annular gap (17) for a properly mounted blank cartridge device (3). On the other hand, for an insufficiently tightened blank cartridge device (3), the combustion gases escape via the same path (i.e., via the gas outlet openings (13, 31) and the annular gap (17)) as well as through the loose cone seat (23, 39).

The sleeve (15) is sealed on the outside of the rear of the extension (7). This seal may be formed, for instance, through shrink-fitting or welding. This sleeve (15) has a displaced inner bore hole (62). The back part of the inner bore hole (62) has a smaller diameter and sits on the outer surface of extension (7). The front part of the inner bore hole (62) has a larger diameter and is spaced somewhat away from the outer surface of the extension (7). This front part covers the gas outlet openings (13), is spaced somewhat away from the outer surface on its front end and, thus, forms the annular gap (17). This annular gap (17) is the forward-turned gas outlet opening of the blank cartridge device (3).

The inner surface of the sleeve (15) is tapered towards the outside as it approaches the annular gap (17). The outside surface of the extension (7) expands conically toward the annular gap (17). As a result, the gases escape forward and outward, which prevents excess soiling of the free outer surface of the blank cartridge device (3).

FIG. 3 shows the blank cartridge device (3) described above after the firing of three live cartridges. As can be seen, the constriction (27) with the injector opening (29) was more or less sheared off by a projectile (45), which created a free passageway (43). However, the core bore holes (9, 25) were either not enlarged or only slightly enlarged by the projectiles. Three such projectiles (45), which were caught by the blank cartridge device (3) of the illustrated example, sit in the front core bore hole (9), which terminates in the tapped blind hole (12) in the stop block (5). These projectiles (45) are only represented schematically; in reality, they would form one single compressed block.

The materials for the stop block (5), the tube (19) and the sleeve (15) are selected such that they optimally correspond to their respective purposes. For example, the tube (19) is strong, but ductile. Consequently, due to the comparatively low resistance with which the constriction (27) opposes a projectile (45), and due to the at least caliber-size core bore hole (25), the tube (19) is primarily stressed when a live cartridge is accidentally fired. On the other hand, the stop block (5) is strong and hard so that it can never be penetrated. The material of sleeve (15) is basically the same as the material of the tube (19).

From the foregoing, persons of ordinary skill in the art will appreciate that a blank cartridge device (3) and a muzzle flash suppressor (35) have been disclosed. In the illustrated example, the muzzle flash suppressor (35) has a longitudinal bore hole (51) on the end facing the barrel muzzle for unobstructed penetration and a central inner cone (39). Lateral openings (37) are provided between this inner cone (39) and the muzzle for gas escape.

The example blank cartridge device (3) has a centrally arranged tube (19) that penetrates the bore hole (51) of the example muzzle flash suppressor (35). The tube (19) is provided with a flat external cone (23) on its rear end, which sits sealed on the inner cone (39) of the muzzle flash suppressor (35). The tube (19) has a core bore hole (25) in communication with the barrel (47). The front end is locked and forms a backstop.

The blank cartridge device (3) of the illustrated example further includes a cover (15), which radially circumvents the lateral openings (37) of the muzzle flash suppressor (35) on the outside. The blank cartridge device (3) also includes an injector bore hole (29) which connects the interior of the core bore hole with the outside. While in most prior art devices, the muzzle flash suppressor must be unscrewed during the use of a blank cartridge device and, thus, can be lost (e.g., with the G3), the illustrated blank cartridge device (3) is pushed onto and attached to the muzzle flash suppressor (35).

In the illustrated example, the blank cartridge device (3) is prevented from flying off the weapon even when the blank cartridge device (3) is improperly attached. The blank cartridge device (3) does not fly off the weapon because the illustrated blank cartridge device (3) includes an injector bore hole (29) in a constriction (27) of the core bore hole (25), which slows down a projectile, as described in further detail below.

The portion of the core bore hole (25) opposite the barrel is connected with the outside via at least a generously measured radial bore hole (31). The tube (19) has an external thread that engages with an internal thread to make a threaded connection (41) in the bore hole (51) of the muzzle flash suppressor (35).

When the threaded connection (41) is tightened, the cone seats (23, 39) are compressed together in a sealing manner. These mutually engaged cone seats are self-closing so that they cannot unscrew themselves. However, should, for example, the threaded connection (41) not be sufficiently tightened, gas may escape through the gap between the cone seats (23, 39) (which are only loosely seated on top of each other). Even in this circumstance, the threaded connection (41) still continues to prevent loosening of the blank cartridge device (3) from the muzzle flash suppressor (35). However, in this circumstance, the powder gases do not just escape through the injector bore hole (29), but rather also escape through the gap between the loosely fitted cone seats (23, 39). Therefore, the weapon cannot be automatically loaded. As a result, the shooter is immediately informed that something is wrong. The shooter is then prompted to examine the blank cartridge device (3), and the shooter can see by turning the tube (19) that the threaded connection (41) is not sufficiently tightened.

The situation with an accidentally fired live shot is more difficult when the threaded connection (41) is not completely screwed down. Indeed, modern weapons cartridges (e.g., 0.223 caliber) have less than half of the muzzle energy of earlier weapons cartridges (e.g., 30-06). Nonetheless, the impact of the live projectile could still possibly be enough to warp and, thus, loosen the thread. However, in the illustrated example, a constriction (27), in which an injector bore hole (29) is located, does not stop the projectile (45), but rather only brakes it. The duration of the impact of the projectile (45) against the blank cartridge device (3) is, therefore, lengthened. Contrary to expectation, the threaded connection (41) withstands this lengthened impact, even if it is not tightened properly, and, thus, the blank cartridge device (3) illustrated herein does not fly off the weapon. In contrast, the method of resolution provided by the prior art (e.g., German Patent No. DE-A-1 578 381) does not achieve this goal.

The first projectile (45) that is received by the blank cartridge device (3) presses both parts of the thread together tightly such that tolerances (if present) are cancelled. As a result, the threaded connection (41) is also in position to withstand the stress from further projectiles (45).

The muzzle flash suppressor (35) works like an attenuator based on its spring capability so that the threaded connection (41) by which the muzzle flash suppressor (35) is attached to the barrel (47) of the weapon (1), is not damaged in any way. Only the blank cartridge device (3) is damaged when absorbing a live shot. The muzzle flash suppressor (35) may possibly also be damaged, but the weapon (1) itself will not suffer any ill effects. This will be true even in the case of a short burst of shots.

The illustrated blank cartridge device (3) is attached to the adjusted muzzle flash suppressor (35) and is not necessarily attached directly to the weapon (1). At the same time, the threaded connection (41) between the muzzle flash suppressor (35) and the blank cartridge device (3) ensures that the blank cartridge device (3) cannot fly off when it is insufficiently attached.

The muzzle side of the tube (19) is inserted into a stop block (5). The stop block (5) includes a center core bore hole (9) which lengthens the core bore hole (25). The tube (19) and the stop block (5) can, thus, be optimized depending on the different conditions, (e.g., an especially ductile material may be used for the tube (19) and a particularly hard material may be used for the stop block (5)).

In another example blank cartridge device (3), the constriction (27) is located outside of the muzzle flash suppressor (35). Thus, damage to the muzzle flash suppressor (35) is avoided if the tube (19) expands due to the impact of a projectile (45) on the constriction (27). Damage to the weapon (1) is, thus, minimized in the case of an accidental firing of a live shot.

Preferably, the rear of the core bore hole (25) has at least the caliber size of the firearm. However, the core bore hole (25) may narrow toward the front. Thus, at least at first, a fired projectile (45) does not grind uncontrollably on the wall of the core bore hole (25), but, rather, the projectile is first warped upon striking the constriction (27) in a controlled manner. Furthermore, abrasion damage is prevented after the cartridge passes the radial bore hole (31). Thus, controlled absorption of several projectiles (45) is possible.

In another implementation of the blank cartridge device (3), the tube (19) is inserted into a stop block (5) on the muzzle side that lengthens the core bore hole (25). The tube (19) and the stop block (5) can thereby be optimized depending on the different conditions, (e.g., an especially ductile material may be used for the tube (19) and a particularly hard material may be used for the stop block (5)).

The illustrated example blank cartridge device (3) is enhanced in that the stop block (5) is extended towards the back and rests in a sealed manner against the back side of the muzzle flash suppressor (35). Radial discharge openings (13) are provided in this extension (7) and are connected with the gas outlet openings (37). A gas chamber is, thus, created between the gas outlet openings (37) of the muzzle flash suppressor (35) and the extension (7) of the stop block (5).

At least one radial bore hole (31) preferably discharges under the extension (7) of the stop block (5) and is connected with the radial openings (13). These radial discharge openings (13) do not necessarily need to discharge to the outside, but rather preferably discharge into the gas outlet openings (37) of the muzzle flash suppressor (35). Any gas flow through the cone seat (23, 39) (e.g., when the blank cartridge device (3) is not properly tightened) also enters into the gas outlet openings (37). The purpose of this measure is to deflect, as often as possible, the gas flow in order to prevent, with certainty, the escape of solid particles from the blank cartridge device (3). Also, additional radial discharge openings discharge to the outside, again through the extension (7).

Preferably, the radial discharge openings (13) of the extension (7) of the stop block (5) are encompassed by an exterior radial deflection sleeve (15) that is open, only towards the front. Thus, the escape of the gases for both blank and live cartridges takes place towards the front. The sleeve (15) causes still another deflection of the gas flow and, thus, guarantees sufficient operation for inadequately tightened blank devices or when a live cartridge is fired.

The illustrated examples prevent the launching of an improperly attached blank cartridge device. This is accomplished, in part, through the use of threaded connections, as described above.

Overall, the illustrated example blank cartridge device (3) and the illustrated example muzzle flash suppressor (35) form a simple device that is small in size. The blank cartridge device (3) does not overlap the muzzle flash suppressor (35) toward the back, has a small outer diameter and remains on the muzzle flash suppressor (35), even when insufficiently tightened. When the blank cartridge device (3) is insufficiently tightened, gas escapes at a second location and automatic reloading of the weapon (1) is prevented. The firing of a live cartridge is possible when the blank cartridge device (3) is attached, without the weapon (1) being damaged and without particles from the projectile (45) making their way outside.

Although certain methods, apparatus and article of manufacture have been described herein, the scope of coverage of this patent is not limited thereto. On the contrary, this patent covers all methods, apparatus and article of manufacture fairly falling within the scope of the claims either literally or under the doctrine of equivalents.

What is claimed is:

1. For use with a firearm having a barrel with a bore, an apparatus comprising:

a muzzle flash suppressor to mount on the barrel, the muzzle flash suppressor including:

a muzzle;

a longitudinal bore including internal threading;

an inner cone in communication with the longitudinal bore; and a lateral opening located in a side of the muzzle flash suppressor between the inner cone and the muzzle of the muzzle flash suppressor; and a blank cartridge device including:

a tube sized to penetrate the longitudinal bore of the muzzle flash suppressor, the tube having external threading to threadingly engage the internal threading in the longitudinal bore of the muzzle flash suppressor, the tube also including an outer cone to form a seal with the inner cone of the muzzle flash suppressor, the tube defining a core bore in communication with the bore of the barrel, the core bore being blocked by a constriction, the constriction defining an injector bore to provide communication between the core bore and a forward portion of the core bore, the core bore being in communication with at least one radial hole;

a cover to radially circumvent the lateral openings of the muzzle flash suppressor; and a stop block to receive the tube, the stop block including a blind hole in communication with the core bore when the stop block receives the tube and the blank cartridge device is mounted on the muzzle flash suppressor.

2. A blank cartridge device as defined in claim 1, wherein the constriction is located outside the muzzle flash suppressor when the stop block receives the tube and the blank cartridge device is mounted on the muzzle flash suppressor.

3. A blank cartridge device as defined in claim 1, wherein a rear of the core bore has at least a caliber size associated with the bore of the firearm.

4. A blank cartridge device as defined in claim 3, wherein a front of the core bore is has a reduced diameter relative to the rear of the core bore.

5. A blank cartridge device as defined in claim 1, wherein the stop block includes an extension which seals against a rear portion of the muzzle flash suppressor.

6. A blank cartridge device as defined in claim 5, wherein a radial discharge opening is defined by the extension, the radial discharge opening being in communication with the lateral opening of the muzzle flash suppressor when the stop block receives the tube and the blank cartridge device is mounted on the muzzle flash suppressor.

7. A blank cartridge device as defined in claim 6, wherein the radial hole is in communication with the radial opening defined by the extension.

8. A blank cartridge device as defined in claim 1, wherein the lateral opening of the muzzle flash suppressor is encompassed by the cover, and the cover forms a forward facing, annular opening when the stop block receives the tube and the blank cartridge device is mounted on the muzzle flash suppressor.

9. A method comprising:

mounting a muzzle flash suppressor on a barrel of a firearm, the muzzle flash suppressor including a longitudinal bore and a lateral opening located in a side of the muzzle flash suppressor;

threading a tube within the longitudinal bore of the muzzle flash suppressor, the tube defining a core bore in communication with a bore of the barrel, the core bore being blocked by a constriction defining an injector bore, the core bore being in communication with at least one radial hole;

threading a stop block onto the tube, the stop block including a blind hole in communication with the core bore when the stop block receives the tube and the blank cartridge device is mounted on the muzzle flash suppressor, the stop block further including a cover surrounding the lateral opening of the muzzle flash suppressor to define a rearward oriented passage in communication with the radial hole and the lateral opening and a forward facing annular opening in communication with the lateral opening, such that discharge gas passes through the core bore, through the radial bore, through the rearward oriented passage, through the lateral opening and through the forward facing annular opening to escape.

* * * * *